US006078002A

United States Patent [19]

Kenmochi

[11] Patent Number: 6,078,002

[45] Date of Patent: Jun. 20, 2000

[54] BASSOON HAVING OBLIQUE LOWER REGISTER TONE HOLES

[75] Inventor: Hiroshi Kenmochi, Shizuoka, Japan

[73] Assignee: Yamaha Corporation, Japan

[21] Appl. No.: 08/986,678

[22] Filed: Dec. 8, 1997

[30] Foreign Application Priority Data

Dec. 6, 1996 [JP] Japan ..... 8-326717

[51] Int. Cl.[7] ..... G10D 7/00

[52] U.S. Cl. ..... 84/380 R

[58] Field of Search ..... 84/380 R, 380 C, 84/382

[56] References Cited

U.S. PATENT DOCUMENTS

| | | | |
|---|---|---|---|
| 2,602,364 | 7/1952 | Loney | 84/382 |
| 3,127,806 | 4/1964 | Fox | 84/380 |
| 3,142,222 | 7/1964 | Polisi | 84/380 |
| 3,198,054 | 8/1965 | Ehrlich | 84/380 |
| 4,714,001 | 12/1987 | Kergomard et al. | 84/386 |

FOREIGN PATENT DOCUMENTS

| | | |
|---|---|---|
| 2648606 | of 1989 | France . |
| 2660-099 | 3/1990 | France . |
| 4113368 | of 1991 | Germany . |

OTHER PUBLICATIONS

Stanley Sadie, "The New Grove Dictionary of Musical Instruments", Macmillan Press Limited, (1984) pp. 176–191.

Dearling, R.: "The Illustrated Encyclopedia of Musical Instruments." Carlton Books LTD, p. 22. 1996.

Robinson, C.W.: "Something About Reed Instruments" pamphlet, Carl Fischer, Inc., New York, pp. 2–4 and 18–21, c1920.

Encyclopedia Britannica, 1994, vol. 1, p. 949a., Encyclopedia Britannica, Inc., Chicago, USA.

*Primary Examiner*—Robert E. Nappi
*Assistant Examiner*—Marlon T. Fletcher
*Attorney, Agent, or Firm*—Ostrolenk, Faber, Gerb & Soffen, LLP

[57] ABSTRACT

Tone holes are formed in a bell joint and a long joint for producing lower register tones Bb, B, C, C#, D and Eb and obliquely extend with respect to a center axis of an air passage formed in the joints in such a manner as to have inner ends closer to a tone hole assigned to a higher register tone than the outer ends thereof, and the oblique tone holes suppress undesirable sharpness in intonation and allow a player to smoothly produce the sounds.

5 Claims, 3 Drawing Sheets

BASSOON HAVING OBLIQUE LOWER REGISTER TONE HOLES

FIELD OF THE INVENTION

This invention relates to a woodwind musical instrument and, more particularly, to a bassoon having oblique lower register tone holes.

DESCRIPTION OF THE RELATED ART

The bassoon belongs to a woodwind musical instrument, and a standard bassoon is broken down into five pieces. FIGS. 1 to 3 illustrate the standard bassoon, and reference numeral 1 designates the prior art bassoon. The prior art bassoon comprises a tenor joint 2, a double joint 3, a long joint 4, a bell joint 5 and a crook 6, and a plurality of tone holes 7 are formed in these joints 2 to 5. The plurality of tone holes 7 are classified into tone holes for lower register sounds, which are sublabelled 7*a*, 7*b*, 7*c*, 7*d*, 7*e* and 7*f*, and tone hole for middle and upper register sounds, which are not sublabelled. The crook 6 is connected to the tenor joint 2, which in turn is connected to the double joint 3. The long joint 4 is further connected to the double joint 3, and the bell joint 5 is connected to the long joint 4. The tenor joint 2, the long joint 4 and the bell joint 5 are tubular configuration, and have respective hollow spaces. A U-letter shaped hollow space is formed in the double joint 3. When the joints 2 to 5 are assembled together, the hollow spaces are connected to one another, and form an air passage 8 for a column of air. The crook 6 is open to the air passage 8, and the tone holes 7 connect the air passage 8 to the air. A reed (not shown) is inserted into the crook, and causes the column of air to vibrate.

A plurality of key mechanisms 9 are provided in association with the tone holes 7, and a player manipulates the key mechanisms 9 so as to selectively open the tone holes 7 for changing the pitches of the sound.

The tone holes 7*a*, 7*b*, 7*c*, 7*d*, 7*e* and 7*f* are formed in the long joint 4 and the bell joint 5, and respectively produces the tones Bb, B, C, C#, D and Eb. These tones Bb to Eb are called as lower register sounds of the lower register, and the tone holes 7*a* to 7*f* are hereinbelow referred to as "lower register tone holes". The lower register tone holes 7*a* to 7*f* have respective center axes 7*g* perpendicular to the center axis of the air passage 8*a* as shown in FIG. 3. However, the center axes of the tone holes for the middle register sounds and the higher register sounds decline with respect to the center axis 8*a*. The perpendicular lower register tone holes 7*a* to 7*f* and the oblique tone holes give the sounds a timbre unique to the bassoon.

However, the prior art bassoon encounters the following problems. First, when a player produces the tones without changing his mouth, the lower register sounds are liable to be sharp pitched, and the player needs to suppress the sharpness of pitch by changing his mouth. Second, the lower register sounds are not smoothly produced at pianissimo. Third, listener feels the lower register sounds stiff.

SUMMARY OF THE INVENTION

It is therefore an important object of the present invention to provide a bassoon, which is free from the problems inherent in the prior art bassoon.

In accordance with the present invention, it has been found that an oblique lower register tone holes solved the problems. Although the oblique lower register tone holes have been not reasoned from the acoustics, the oblique lower register tone hole is effective against the undesirable sharpness of pitch and the non-smooth stiff tones.

In accordance with one aspect of the present invention, there is provided a bassoon comprising a plurality of tubular members connected to one another for forming an air passage therein and formed with tone holes having respective inner ends open to the air passage and respective outer ends open to outer surfaces of the plurality of tubular member and a plurality of key mechanisms provided on the outer surfaces of the plurality of tubular members for selectively changing the tone holes between open-state and closed-state, and at least one of the tone holes assigned to a lower register sound obliquely extending with respect to a center axis of the air passage so as to have the inner end closer to another tone hole assigned to a higher-pitched sound than the outer end thereof.

BRIEF DESCRIPTION OF THE DRAWINGS

The features and advantages of the bassoon will be more clearly understood from the following description taken in conjunction with the accompanying drawings in which.

DESCRIPTION OF THE PREFERRED EMBODIMENT

Figure 1:
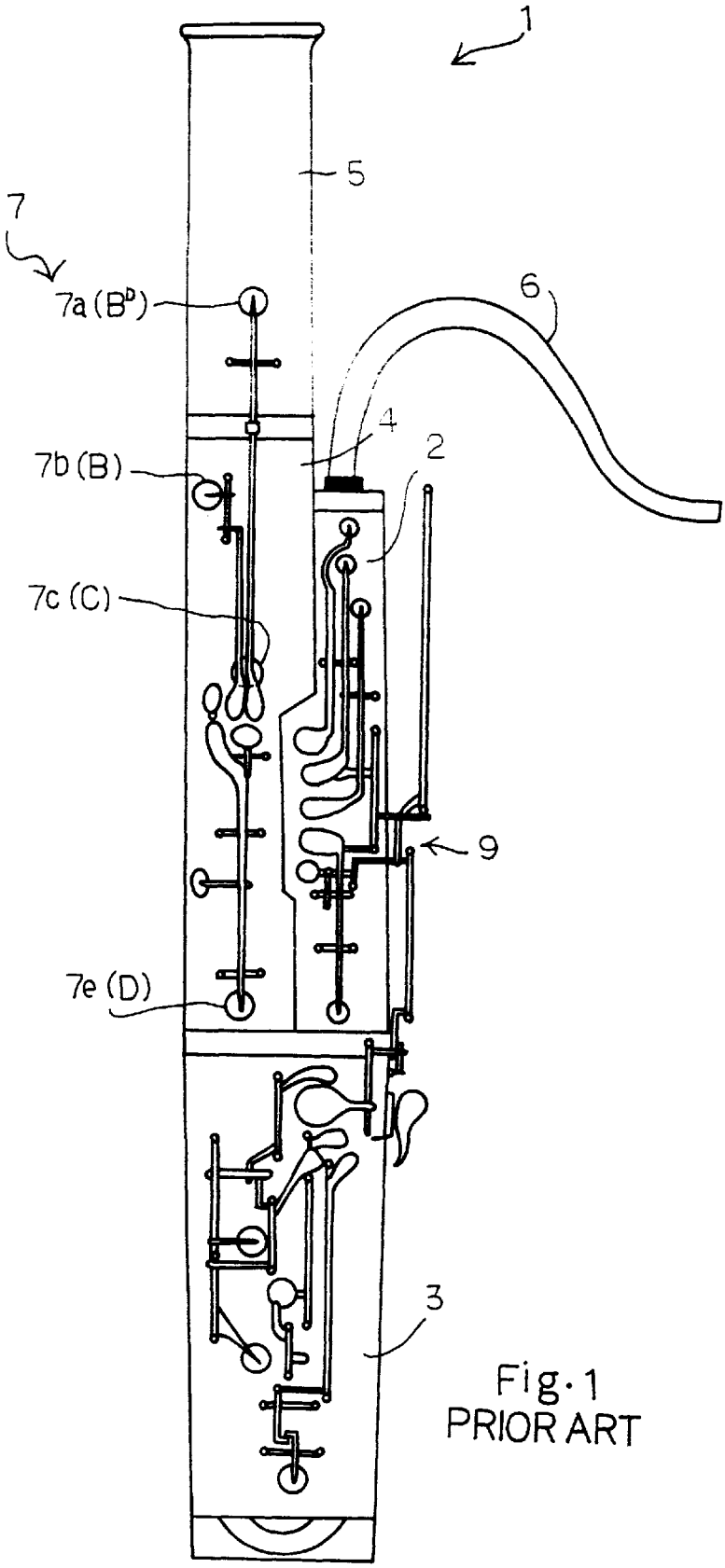
Fig. 1 PRIOR ART
FIG. 1 is a left side view showing the prior art bassoon.
Figure 2:
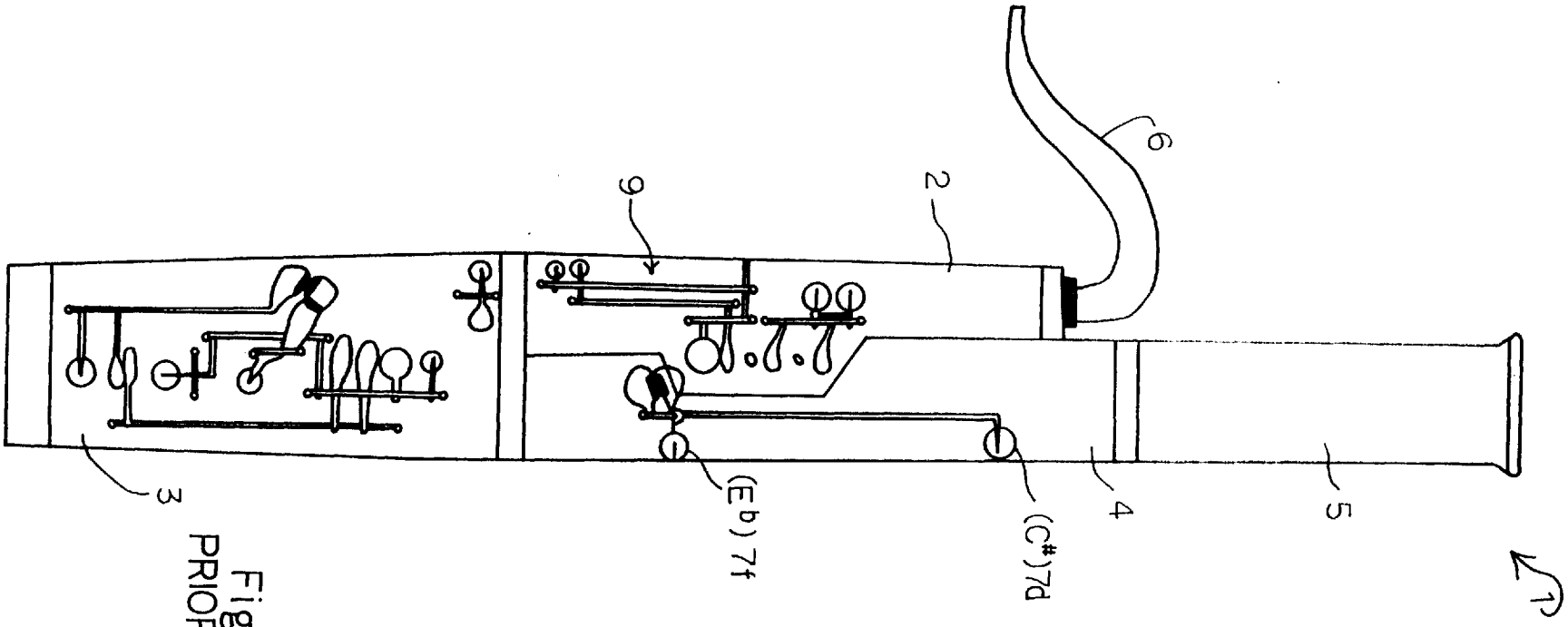
Fig. 2 PRIOR ART
FIG. 2 is a right side view showing the prior art bassoon.
Figure 3:
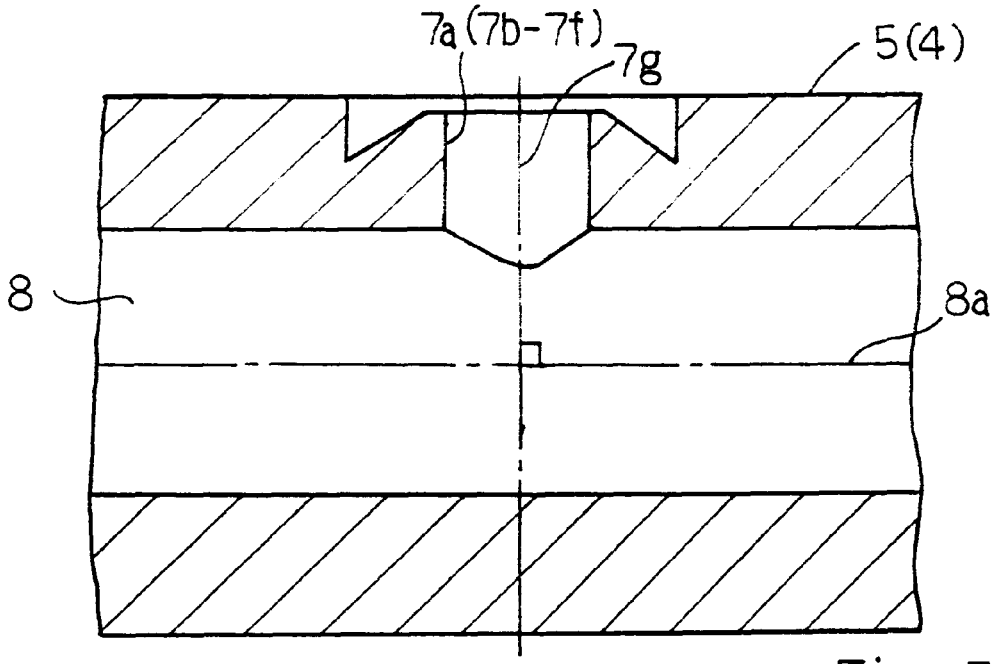
Fig. 3 PRIOR ART
FIG. 3 is a cross sectional view showing a tone hole formed in the prior art bassoon.
Figure 4:
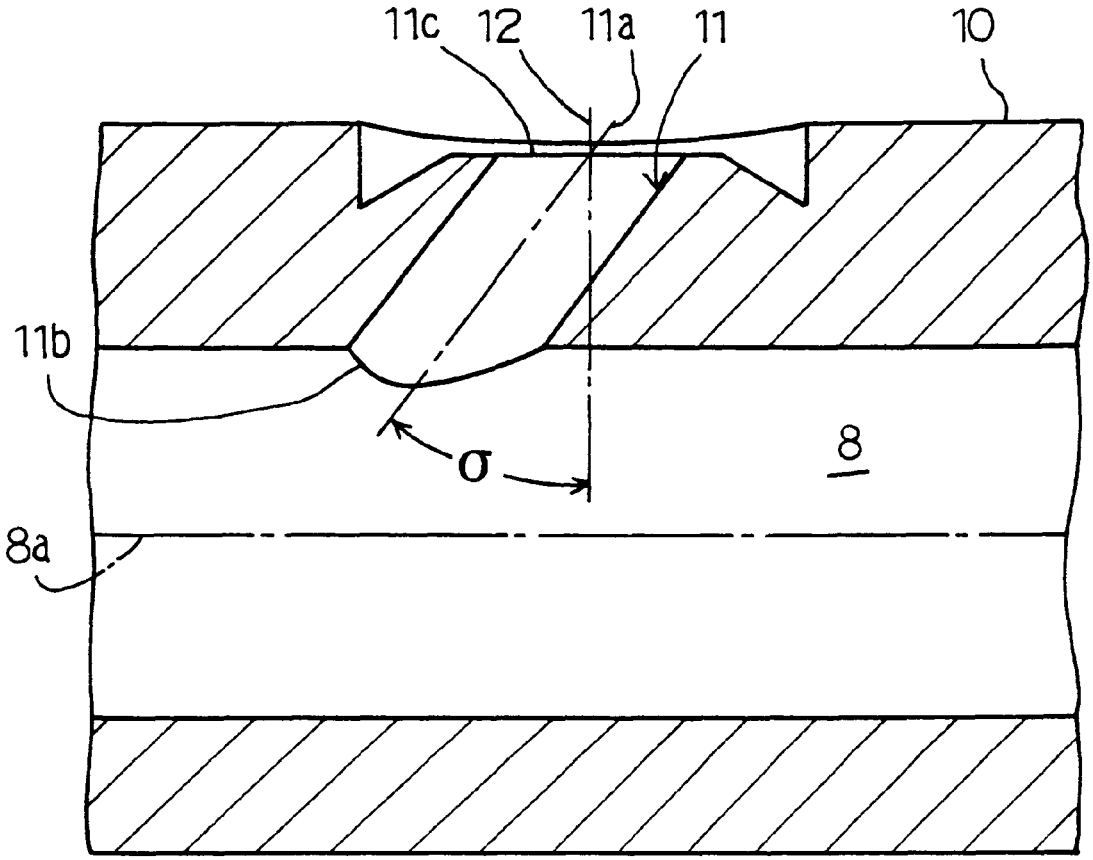
FIG. 4 is a cross sectional view showing a tone hole formed in a bassoon according to the present invention.

FIG. 4 illustrates a part of a bassoon embodying the present invention. The bassoon of the present invention is similar to the prior art bassoon except for lower register tone holes respectively assigned to the tones Bb, B, C, C#, D and Eb. The external appearance of the bassoon is identical with that of the prior art bassoon shown in FIGS. 1 and 2, and other component members of the bassoon according to the present invention are designated by reference numerals which are the same as those of the corresponding component members of the prior art bassoon.

A tubular member 10 represents either bell or long joint 4/5, and a part of the air passage 8 extends along the center line 8*a*. In the following description, term "lower register sounds" means Bb, B, C, C#, D and Eb, and tone holes assigned to the lower register sounds are referred to as "lower register tone holes".

A declined lower register tone hole 11 is formed in the tubular member 10. The declined lower register tone hole 11 is straight, and has a center line 11*a* obliquely extending with respect to the center line 8*a*. Reference numeral 12 designates a virtual line perpendicular to the center line 8*a*. The center line 11*a* declines at angle $\sigma$ with respect to the virtual line 12. Thus, the declined lower register tone hole 11 obliquely extends so that the inner end 11*b* is closer to the tone holes 7 assigned to higher register tones or the crook 6 than the outer end 11*c*. In other words, the outer end 11*c* is closer to the tone holes assigned to a lower-pitched sound or the bell joint 5. In this instance, all the lower register tone holes 7*a* to 7*f* are obliquely formed as declined in FIG. 4.

The angle $\sigma$ was changed and the lower register sounds, and evaluated. When the angle $\sigma$ ranged between 10 degrees and 20 degrees, i.e., $10° \leqq \sigma \leqq 20°$, the lower register sounds were better rather than that of the prior art bassoon; the intonation was not unintentionally sharp, the lower register sounds were soft, and the player easily produced the lower register sounds at pianissimo. When the angle σ ranged between 13 degrees and 16 degrees, the lower register sounds were optimized without the problems inherent in the prior art bassoon.

As will be appreciated from the foregoing description, the present invention surely improves the lower register sounds and the generation thereof by using the declined lower register tone holes 11.

Although a particular embodiment of the present invention has been shown and described, it will be obvious to those skilled in the art that various changes and modifications may be made without departing from the spirit and scope of the present invention. For example, selected one or ones of the lower register tone holes may be oblique with respect to the center axis of the air passage, and the others are perpendicular to the center axis.

What is claimed is:

1. A bassoon which comprises:

a plurality of tubular members connected to one another for forming an air passage therein and formed with tone holes having respective inner ends open to said air passage and respective outer ends open to outer surfaces of said plurality of tubular members, at least one of said tone holes assigned to a lower register sound obliquely extending with respect to a center axis of said air passage so as to have the inner end closer to another tone hole assigned to a higher-pitched sound than the outer end thereof, and a plurality of key mechanisms provided on said outer surfaces of said plurality of tubular members for selectively changing said tone holes between open-state and closed-state.

2. The bassoon as set forth in claim 1, in which said lower register sound has a note selected from the group consisting of Bb, B, C, C#, D and Eb.

3. A bassoon which comprises:

a plurality of tubular members connected to one another for forming an air passage therein and formed with tone holes having respective inner ends open to said air passage and respective outer ends open to outer surfaces of said plurality of tubular members, at least one of said tone holes assigned to a lower register sound having a note selected from the group consisting of Bb, B, C, C#, D and Eb, said at least one tone hole obliquely extending with respect to a center axis of said air passage so as to have the inner end closer to another tone hole assigned to a higher-pitched sound than the outer end thereof and declining with respect to said center axis of said air passage at a predetermined angle between 10 degrees to 20 degrees; and a plurality of key mechanisms provided on said outer surfaces of said plurality of tubular members for selectively changing said tone holes between open-state and closed-state.

4. The bassoon as set forth in claim 2, in which said at least one of said tone holes is formed in one of said plurality of tubular members called as a bell joint or a long joint.

5. The bassoon as set forth in claim 1, in which the tone holes respectively assigned to the notes Bb, B, C, C#, D and Eb are similar to said at least one of said tone holes.

* * * * *